United States Patent [19]

Hoehn

[11] Patent Number: 4,457,123

[45] Date of Patent: Jul. 3, 1984

[54] METHOD AND APPARATUS FOR DEPACKING ARTICLES

[76] Inventor: John W. Hoehn, 7 Webb St., Middle Brighton, Victoria, Australia

[21] Appl. No.: 329,312

[22] Filed: Dec. 10, 1981

[30] Foreign Application Priority Data

Dec. 11, 1980 [AU] Australia ..... PE6898

[51] Int. Cl.[3] ..... B65B 43/38

[52] U.S. Cl. ..... 53/492; 53/381 R; 414/412; 414/20

[58] Field of Search ..... 53/492, 381 R, 372; 414/412, 403, 20, 112, 124

[56] References Cited

U.S. PATENT DOCUMENTS 3,263,843 8/1966 Grahn et al. ..... 414/412
3,471,990 10/1969 Bonuchi et al. ..... 53/372 X
3,889,442 6/1975 Grahn et al. ..... 53/492
4,034,877 7/1977 Bennison ..... 414/412

*Primary Examiner*—Horace M. Culver
*Attorney, Agent, or Firm*—Bucknam and Archer

[57] ABSTRACT

A method and apparatus of removing articles from a package wherein the articles are arranged in a plurality of side by side rows and sealed in a film of thermoplastic material wherein the package is positioned with the rows of articles supported on a horizontal base, and then the package is severed into two sections along a plane passing between two adjacent rows of articles, the two severed package sections are then withdrawn from the assembly of articles by drawing each section in a direction normal to the severing plane.

10 Claims, 1 Drawing Figure

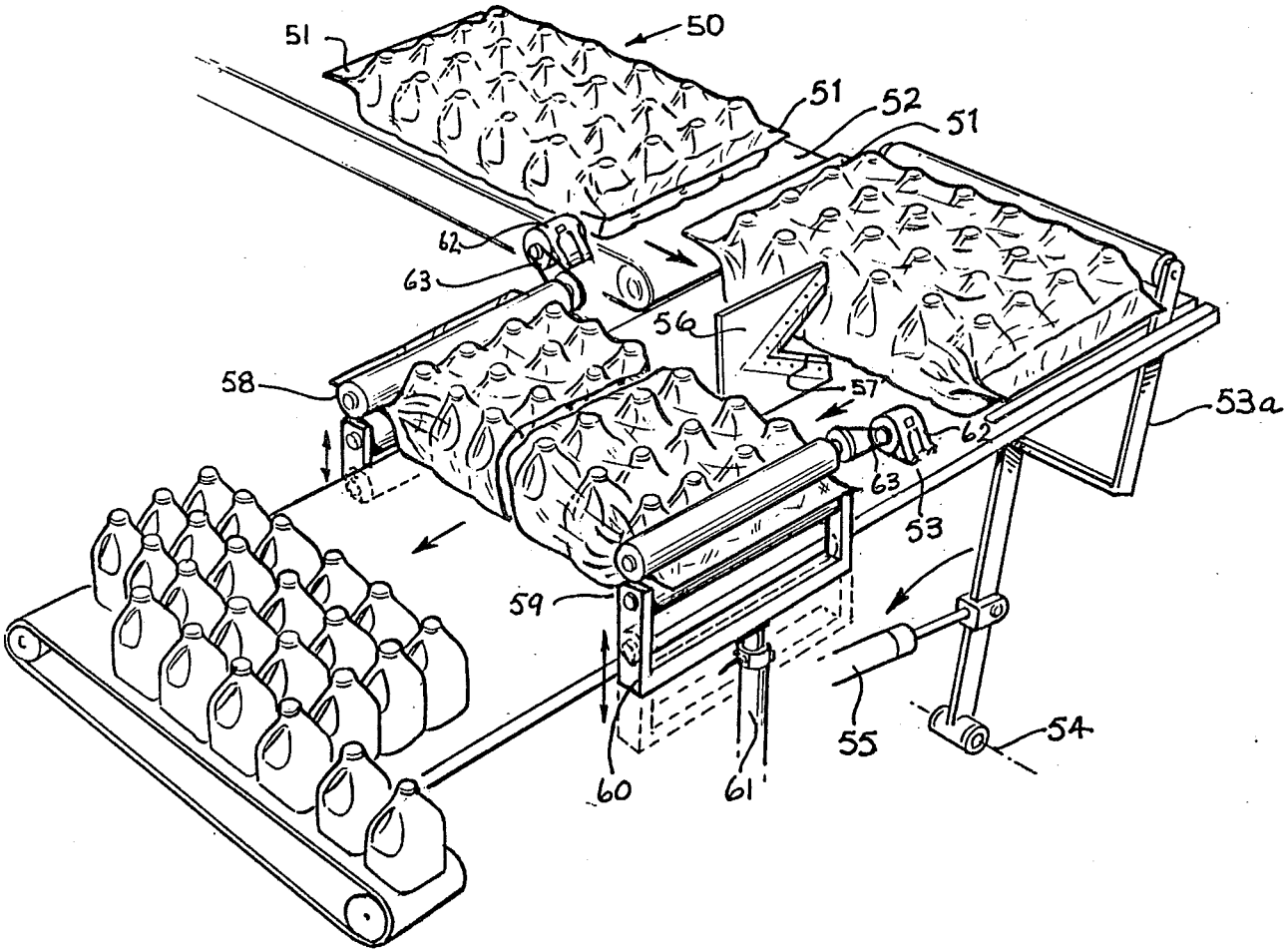
53a
54
55
53
62
63
57
61
60
59
56
50
51
52
51
51
62
63
58

METHOD AND APPARATUS FOR DEPACKING ARTICLES

It is a widely accepted practice to package a plurality of articles in an envelope of thermoplastic film or sheet material for convenience in handling and transporting. The thermoplastic material of the envelope is in a tensioned state so that the plurality of articles encased therein retain a pre-arranged formation during such handling and transportation.

In one use of this form of packaging unfilled containers are enclosed in an envelope of thermoplastic material immediately after manufacture of the containers so that the containers, are not subject to subsequent contamination. In some instances the containers are of a moulded plastic construction, and are considered to be substantially sterile at the time of manufacture, and consequently are immediately assembled into a formation and wrapped within the envelope of thermoplastic material thereby maintaining the substantially sterile condition during subsequent handling and transportation.

Although this form of packaging does render handling and transporting of the articles such as containers convenient, it does present a problem in subsequently removing the thermoplastic envelope and arranging the articles therein for subsequent processing. Because of the flimsy nature of the envelope material, once it is split for the purposes of removing the articles from the package, there is a minimal restraint on movement of the articles, and thus they may readily depart from their row formation and also some or all may fall over into a different orientation. Accordingly it is then necessary to manually handle the containers to appropriately orientate them for subsequent processing into filling machines or the like. This of course involves additional costs, and also may lead to contamination of the articles, particularly if they are containers to be subsequently filled with material for human consumption.

It is therefore the principal object of the present invention to provide a method and apparatus for removing articles from a package of a type hereinafter defined, so that the articles are retained in the required relative disposition and orientation for subsequent processing.

With this object in view there is provided a method of removing articles from a package of the type as hereinafter defined comprising positioning the package with the rows of articles supported on a horizontal base, severing the package along a plane passing between two adjacent rows of articles to thereby cut the package into two sections, and drawing each package section so formed in a direction normal to said plane to remove the package sections from the formation of articles.

In the preceding paragraph, and throughout the specification, the word "package" means a plurality of articles arranged in a number of parallel rows to provide a rectangular formation, and sealed in an envelope of flexible thermoplastic material.

Preferably the two opposite ends of the package, parallel to the plane of severing, are provided with respective fins. The fins are respectively gripped between rollers after the severing step and the package sections are withdrawn by the rollers.

Conveniently the package is fed past a blade, or a blade if fed past the package to effect said severing of the package into the two sections.

There is also provided a machine for removing articles from a package of the defined type comprising a base to support said package, means for severing the package along a plane between two adjacent rows of articles to form two package sections, and means grip and withdraw each package section in a direction normal to said plane.

Conveniently the severing means comprising a blade, and means are provided to effect relative movement between the blade and the package to form said to package sections. Preferably the blade is fixed and a pusher arm moves the package past the blade.

Preferably rollers are provided to engage the respective sections of the severed package to withdraw the sections from the articles. Preferably two spaced pairs of rollers are provided adjacent opposite ends of the package. Each pair of these rollers may be one roller movable relative to one another to provide in one position a gap to allow free entry of the respective fin between the rollers when the package is moved past the blade, and in another position to close on the respective fin, the rollers being driven in a direction to withdraw the severed section of package attached to the respective fin from the assembly of articles.

One practical arrangement of the apparatus is shown in FIG. 1 of the accompanying drawings, which is a perspective view of the apparatus for effecting the removal of the envelope from the articles.

The plurality of containers are enclosed in a package of plastic film material 50 with a transverse fin 51 extending across the two opposite transverse ends of the package.

The packages are moved in succession along the conveyor 54 onto a cutting platform 53. A pusher arm 53A is pivotally mounted at 54 and extends through slots in platform 53. Under the control of the power cylinder 55 the package is caused to move in a direction parallel to the length of the fin 51.

The fixed blade 56 having a V-shaped cutting edge 57, is in the path of movement of the package resulting from the pivotal movement of the pusher arm **53*a*** so that the package may move into the V-shaped cutting edge, and the material of the package is severed along a plane parallel to the movement of the package and passing between two adjacent rows of the articles in the package.

After passing the blade 56, the package, which is now severed into two sections, moves between two spaced pairs of rollers 58 and 59 disposed adjacent opposite ends of the package. The rollers of each pair may be moved relative to one another by means of yoke 60 and power cylinder 61 to increase the gap between the rollers to permit the free entry of the respective fins 51 of the package between the rollers of each pair, as shown in phantom in the drawing. The pairs of rollers are then closed on the fin by reversing the movement of power cylinder 61. The rollers are then driven, by motors 62 and associated drive trains 63 in a direction so that the section of the package attached to the fin is withdrawn through the rollers and hence freed from the assembly of articles.

It will be appreciated that during the operation of the rollers, the assembly of articles in each section of the package tend to be drawn towards the rollers however the rollers act as a stop against such movement and the articles are retained substantially in their initial position whilst the packaging material is withdrawn through the rollers.

After the withdrawal of the respective sections of packaging material, the articles originally contained within the package are now free to be further processed as required.

What I claim is:

1. A method of removing articles from a package comprising a plurality of articles in a number of parallel rows to provide a rectangular formation, said articles being encased in an envelope of flexible thermoplastic film, said method comprising positioning the package with the rows of articles supported on a horizontal base, severing the flexible thermoplastic film of said package along a plane passing between adjacent rows of said articles to thereby cut the film into two sections, gripping each said film section by separate opposed film removal means, and each said film removal means acting to draw a respective one of said film sections from the formation of articles in a direction normal to said plane while said removal means engages with said articles supported on said horizontal base to maintain said articles in said formation.

2. A method according to claim 1 wherein opposite ends of the package parallel to the plane of severing have respective fins, said fins being gripped by said removal means.

3. A method according to claim 1 wherein each said removal means comprises a pair of rollers with the film sections being receivable between and gripped by the pair of rollers.

4. A method according to claim 1 including feeding the package past a blade to effect severing of the package into said two film sections.

5. A method according to claim 1 including feeding a blade past the package to effect said severing of the package into said two film sections.

6. A machine for removing articles from a package comprising a plurality of articles in a number of parallel rows to provide a rectangular formation, said articles being encased in an envelope of flexiable thermoplastic film, said machine comprising a substantially horizontal base for supporting said package, means for severing the package along a plane between two adjacent rows of said articles to thereby cut the flexible thermoplastic film into two sections, and separate opposed film removal means arranged to grip and withdraw a respective one of said film sections from the formation of articles in a direction normal to said plane, said separate film removal means being adapted to engage said articles to maintain said articles in said formation while simultaneously withdrawing said film sections.

7. A machine as claimed in claim 6 wherein the severing means comprises a blade, and means are provided to effect relative movement between the blade and the package to form said two film sections.

8. A machine as claimed in claim 6 wherein the severing means comprises a fixed blade and a pusher arm moves the package past the blade.

9. A machine as claimed in claim 6 wherein said removal means comprises respective pairs of rollers to engage and grip the respective severed film sections of the package to withdraw said sections from the articles.

10. A machine as claimed in claim 9 wherein each pair of rollers has one roller movable relative to the other to provide a gap between the rollers permitting free entry of the film of a respective film section, and to close to grip the said film, said rollers being driven in a direction to withdraw the severed film section of package from the formation of articles when the rollers are closed on the film section.

* * * * *